US005267887A

United States Patent [19]

Licata et al.

[11] Patent Number: 5,267,887

[45] Date of Patent: Dec. 7, 1993

[54] BUNGEE JUMPING TOY

[76] Inventors: Anthony Licata, 19313 18th Ave., Covington, La. 70433; Roy Bordes, 19 Madison St., Mandeville, La. 70448

[21] Appl. No.: 63,669

[22] Filed: May 30, 1993

[51] Int. Cl.[5] ..... A63H 11/06; A63H 17/12

[52] U.S. Cl. ..... 446/309; 446/315; 446/384; 446/490; 446/425

[58] Field of Search ..... 446/314, 315, 308, 309, 446/311, 361, 362, 427, 426, 425, 267, 490, 323, 384

[56] References Cited

U.S. PATENT DOCUMENTS

| | | | |
|---|---|---|---|
| 1,660,780 | 2/1928 | Arden | 446/426 |
| 2,013,568 | 9/1935 | Mallard | 446/314 |
| 2,430,971 | 11/1947 | Atlas | 446/323 |
| 2,941,331 | 6/1960 | Ottolini | 446/309 |
| 3,715,121 | 2/1973 | Renn et al. | 446/308 X |
| 4,312,149 | 1/1982 | Iwao | 446/426 X |

*Primary Examiner*—Mickey Yu
*Attorney, Agent, or Firm*—S. Michael Bender

[57] ABSTRACT

A new and improved bungee jumping toy includes an elevated platform and a platform support assembly, e.g. a toy crane, for supporting the elevated platform at a predetermined height above ground level. A jumper figure is capable of selectively standing on the elevated platform or of selectively jumping off the elevated platform. A cord supply assembly is retained by the cab portion of the crane. A resilient cord has a first cord portion connected to the jumper figure and has a second cord portion retained by the cord supply assembly. A first manual control assembly, which includes a manually operated first lever, is located in the cab portion of the crane and is used for controlling a length of the resilient cord payed out from the cord supply assembly to the jumper figure as the jumper figure undergoes a jump. The first lever controls a first control line connected to a brake plate assembly, such that when the first lever is actuated, the first control line pulls on the brake plate assembly and halts paying out of the resilient cord from the cord supply assembly. The first cord portion of the resilient cord is connected to feet members of the jumper figure. The jumper figure includes a retractable head assembly which has an extended or normal position and a retracted position which occurs when the head assembly smacks up against a ground surface or a bottom of a pool element.

15 Claims, 4 Drawing Sheets

BUNGEE JUMPING TOY

BACKGROUND OF THE INVENTION

1. Field of the Invention

The present invention relates generally to toys that simulate real life activities, and more particularly, to a toy especially adapted for simulating the sport of bungee jumping.

2. Description of the Prior Art

The sport of bungee jumping has many desirable characteristics which have contributed to its increasing popularity over the years. Such characteristics include, among others, near free fall conditions, the speed of falling through the air, the bouncing effect contributed by the bungee cord, the thrill of successfully completing the endeavor, and the feeling of self-satisfaction and self-confidence for successfully meeting the challenge.

Yet, not every one is ready, willing, able, or eligible to participate in the sport of bungee jumping. For example, as currently conducted, bungee jumping is not permitted for children. Also, bungee jumping is not permitted for the physically infirmed. In this respect, it would be desirable if a device were provided that permitted children to experience some of the desirable characteristics of bungee jumping without actually participating in bungee jumping. In addition, it would be desirable if a device were provided that permitted the physically infirmed to experience some of the desirable characteristics of bungee jumping without actually participating in bungee jumping.

There are other individuals who, though permitted to participate in bungee jumping, do not choose to do so for a number of reasons. One reason for not participating is the expense. It is a quite expensive sport. A bungee jumping operation must use an adequate lot of land and must employ expensive equipment such as a very expensive crane. In this respect, it would be desirable if there were a device that provided some of the desirable characteristics of bungee jumping without the need for expensive equipment and expensive land use.

Some individuals, though permitted to engage in bungee jumping, choose not to do so because of a fear of heights or a fear of the bungee cord breaking with fatal results. In this respect, it would be desirable if there were a device that provided some of the desirable characteristics of bungee jumping without requiring a person to go to elevated heights. In addition, it would be desirable if there were a device that provided some of the desirable characteristics of bungee jumping without subjecting a participant to physical danger if the bungee cord were to break during a jump.

The sport of bungee jumping is often conducted at locations that are remote from a person's home. Therefore, to participate in the sport, one must sometimes travel considerable distances away from home to reach the bungee jumping site. In this respect, it would be desirable if there were a device that provided some of the desirable characteristics of bungee jumping without requiring a person to travel considerable distances away from home.

When different participants engage in bungee jumping, there if often a competition created between the participants. One person may jump from a greater height than another. One person may come closer to the ground or water surface than another before the first bounce. In this respect, it would be desirable if there were a device that provided some competitive aspects of bungee jumping without any of the physically challenging aspects of the sport.

Given some of the advantages of bungee jumping and given some of the disadvantages as well, it would be desirable if a simulated bungee jumping apparatus were provided that provided some of the advantages and, at the same time, eliminated some of the disadvantages of the sport of bungee jumping.

As mentioned above, the sport of bungee jumping often employs large cranes. Peoples interest in the useful and complex features of cranes has resulted in the production of a number of toy cranes such as represented by the following U.S. Pat. Nos. 3,475,851; 3,589,724; 3,997,061; Des. 262,560; and Des. 271,782. Yet there is no disclosure in the patents for these toy cranes indicating their use in a toy for simulating bungee jumping. In this respect, it would be desirable if a device were provided that simulated bungee jumping and that employed a toy crane.

In the sport of bungee jumping, the participant, who is elevated to the jumping off height by the crane, makes the final decision as to when to make the jump. In this respect, it would be desirable if a simulated bungee jumping device were provided that enabled the participant to make the final decision as to when to make the jump.

In real bungee jumping, a person may have choices to make with respect to certain parameters of the jump. For example, the jumper may choose the height of the jumping off point above the ground or water surface. The jumper may choose the length of the bungee cord. The jumper may also choose the thickness or resilience of the bungee cord. With an appropriate selection of parameters, the jump can maximize speed and bounce and minimize the distance between the bottommost point of the fall and the ground or water surface. Such a jump will exemplify the best in bungee jumping. However, if the specific parameters chosen are chosen to be extra safe, then speed may not be maximized, and the distance between the bottommost point of the fall and the ground or water surface may be relatively large. Such a jump will be less than optimum. In this respect, it would be desirable if a simulated bungee jumping device were provided that rewarded a participant for executing a jump that maximized speed, that maximized the height of the jump, and that minimized the distance between the bottommost point of the fall and the ground or water surface.

On the other hand, if the person in real bungee jumping makes a poor choice of jumping parameters, then the result may be catastrophic. The person may crash into the ground, or the person may undesirably become immersed in a body of water. In this respect, it would be desirable if a simulated bungee jumping device were provided that penalized a participant for executing a jump in which the jumper crashed into the ground, or the jumper became undesirably immersed in a body of water.

In real bungee jumping, if a person crashes into the ground, the person's body may undergo catastrophic mangling or damage. In this respect, it would be desirable if a simulated bungee jumping device were provided in which a simulated person underwent simulated damage if the simulated person crashes into the ground.

Thus, while the foregoing body of prior art indicates it to be well known for persons to participate in the sport of bungee jumping, the prior art described above does not teach or suggest a bungee jumping toy which has the following combination of desirable features: (1) permits children to experience some of the desirable characteristics of bungee jumping without actually participating in bungee jumping; (2) permits the physically infirmed to experience some of the desirable characteristics of bungee jumping without actually participating in bungee jumping; (3) provides some of the desirable characteristics of bungee jumping without the need for expensive equipment and expensive land use; (4) does not require a person to go to elevated heights; (5) does not subject a participant to physical danger if the bungee cord were to break during a jump; (6) does not require a person to travel considerable distances away from home; (7) provides some competitive aspects of bungee jumping without any of the physically challenging aspects of the sport; (8) provides some of the advantages of and, at the same time, eliminates some of the disadvantages of the sport of bungee jumping; (9) similates bungee jumping and employs a toy crane; (10) rewards a participant for executing a jump that maximizes speed, that maximizes the height of the jump, and that minimizes the distance between the bottommost point of the fall and the ground or water surface; (11) penalizes a participant for executing a jump in which the jumper crashes into the ground or the jumper becomes undesirably immersed in a body of water; and (12) simulates damage to a simulated person if the simulated person crashes into the ground. The foregoing desired characteristics are provided by the unique bungee jumping toy of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved bungee jumping toy apparatus which includes an elevated platform and a platform support assembly for supporting the elevated platform at a predetermined height above ground level. The platform support assembly includes a vertically extending portion which supports the elevated platform and a control portion which supports the vertically extending portion. A jumper figure is capable of selectively standing on the elevated platform or of selectively jumping off the elevated platform.

A cord supply assembly is retained by the platform support assembly. A resilient cord has a first cord portion connected to the jumper figure and has a second cord portion retained by the cord assembly. A first manual control assembly, supported by the platform support assembly, is used for controlling a length of the resilient cord payed out from the cord supply assembly to the jumper figures as the jumper figure undergoes a jump. The first manual control assembly includes a pivoted, rubber-band-biased first lever, a first control line connected to the first lever, and a brake plate assembly connected to the first control line, such that when the first lever is actuated, the first control line pulls on the brake plate assembly and halts paying out of the resilient cord from the cord supply assembly. The brake plate assembly halts paying out of the resilient cord from the cord supply assembly by clamping a portion of the resilient cord between a friction plate in the brake plate assembly and a bottom surface of the elevated platform.

The platform support assembly is comprised of a toy crane. The first cord portion of the resilient cord is connected to feet members of the jumper figure. The jumper figure includes a retractable head assembly. The retractable head assembly includes a head member, a neck member connected to the head member, and a torso member which includes a well which slidingly receives the neck member. A force exerting assembly is supported by the torso member. The force exerting assembly means impedes sliding motion of the neck member within the well, such that when the head member is moved toward the torso member, the head member maintains its position near the torso member.

The force exerting assembly includes a neck-brake member which contacts the neck member. A spring member is in contact with the neck-brake member and exerts a biasing force against the neck-brake member. An adjustment element is in contact with the spring member and is used for adjusting the frictional force of the spring member against the neck-brake member and the neck member. The neck member includes a groove for receiving the neck-brake member.

A catapult assembly is connected to the elevated platform and is used for catapulting the jumper figure when the jumper figure undergoes a jump. The catapult assembly includes a spring board assembly which has a first end connected to the elevated platform. A latch assembly is releasably connected to a second end of the spring board assembly. A board tensioning member is placed between the spring board assembly and an upper surface of the elevated platform. A second control line is connected to the latch assembly and a second manual control assembly supported by the platform support assembly. The second control line is connected between the latch assembly and the second manual control assembly, such that when the second manual control assembly is actuated, the second control line releases the latch assembly, and the spring board assembly catapults the jumper figure off of the elevated platform.

The second manual control assembly includes a pivoted, rubber-band-biased second lever connected to the second control line, such that when the second lever is actuated, the second control line releases the latch assembly and the spring board assembly which catapults the jumper figure off of the elevated platform. The latch assembly includes a pivoted, spring-biased latch element, a pivot, a pivot support, and a line guide for directing a pull on the spring-biased latch element by the second control line and the second lever to be directed away from the spring board assembly to release the spring board assembly from the spring-biased latch element and to catapult the jumper figure into a jump.

A ballast tank containing water as ballast is located below the bottom of the control portion of the platform support assembly. A pool element is connected to the ballast tank by a flexible hose. The water in the pool element can be drained into the ballast tank by elevating the pool element above the level of the ballast tank.

The above brief description sets forth rather broadly the more important features of the present invention in order that the detailed description thereof that follows may be better understood, and in order that the present contributions to the art may be better appreciated. These are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved bungee jumping toy which has all of the advantages of the prior art and none of the disadvantages.

It is another object of the present invention to provide a new and improved bungee jumping toy which may be easily and efficiently manufactured and marketed.

It is a further object of the present invention to provide a new and improved bungee jumping toy which is of durable and reliable construction.

An even further object of the present invention is to provide a new and improved bungee jumping toy which is susceptible of a low cost of manufacture with regard to both materials and labor, and which accordingly is then susceptible of low prices of sale to the consuming public, thereby making such bungee jumping toy available to the buying public.

Still yet a further object of the present invention is to provided a new and improved bungee jumping toy which permits children to experience some of the desirable characteristics of bungee jumping without actually participating in bungee jumping.

Still another object of the present invention is to provide a new and improved bungee jumping toy that permits the physically infirmed to experience some of the desirable characteristics of bungee jumping without actually participating in bungee jumping.

Yet another object of the present invention is to provide a new and improved bungee jumping toy which provides some of the desirable characteristics of bungee jumping without the need for expensive equipment and expensive land use.

Even another object of the present invention is to provide a new and improved bungee jumping toy that does not require a person to go to elevated heights.

Still a further object of the present invention is to provide a new and improved bungee jumping toy which does not subject a participant to physical danger if the bungee cord were to break during a jump.

Yet another object of the present invention is to provide a new and improved bungee jumping toy that does not require a person to travel considerable distances away from home.

Still another object of the present invention is to provide a new and improved bungee jumping toy which provides some competitive aspects of bungee jumping without any of the physically challenging aspects of the sport.

Yet another object of the present invention is to provide a new and improved bungee jumping toy provides some of the advantages of and, at the same time, eliminates some of the disadvantages of the sport of bungee jumping.

Still a further object of the present invention is to provide a new and improved bungee jumping toy that simulates bungee jumping and employs a toy crane.

Yet another object of the present invention is to provide a new and improved bungee jumping toy which rewards a participant for executing a jump that maximizes speed, that maximizes the height of the jump, and that minimizes the distance between the bottommost point of the fall and the ground or water surface.

Still a further object of the present invention is to provide a new and improved bungee jumping toy that penalizes a participant for executing a jump in which the jumper crashes into the ground or the jumper becomes undesirably immersed in a body of water.

Yet another object of the present invention is to provide a new and improved bungee jumping toy which simulates damage to a simulated person if the simulated person crashes into the ground.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved bungee jumping toy embodying the principles and concepts of the present invention will be described.

Figure 1:
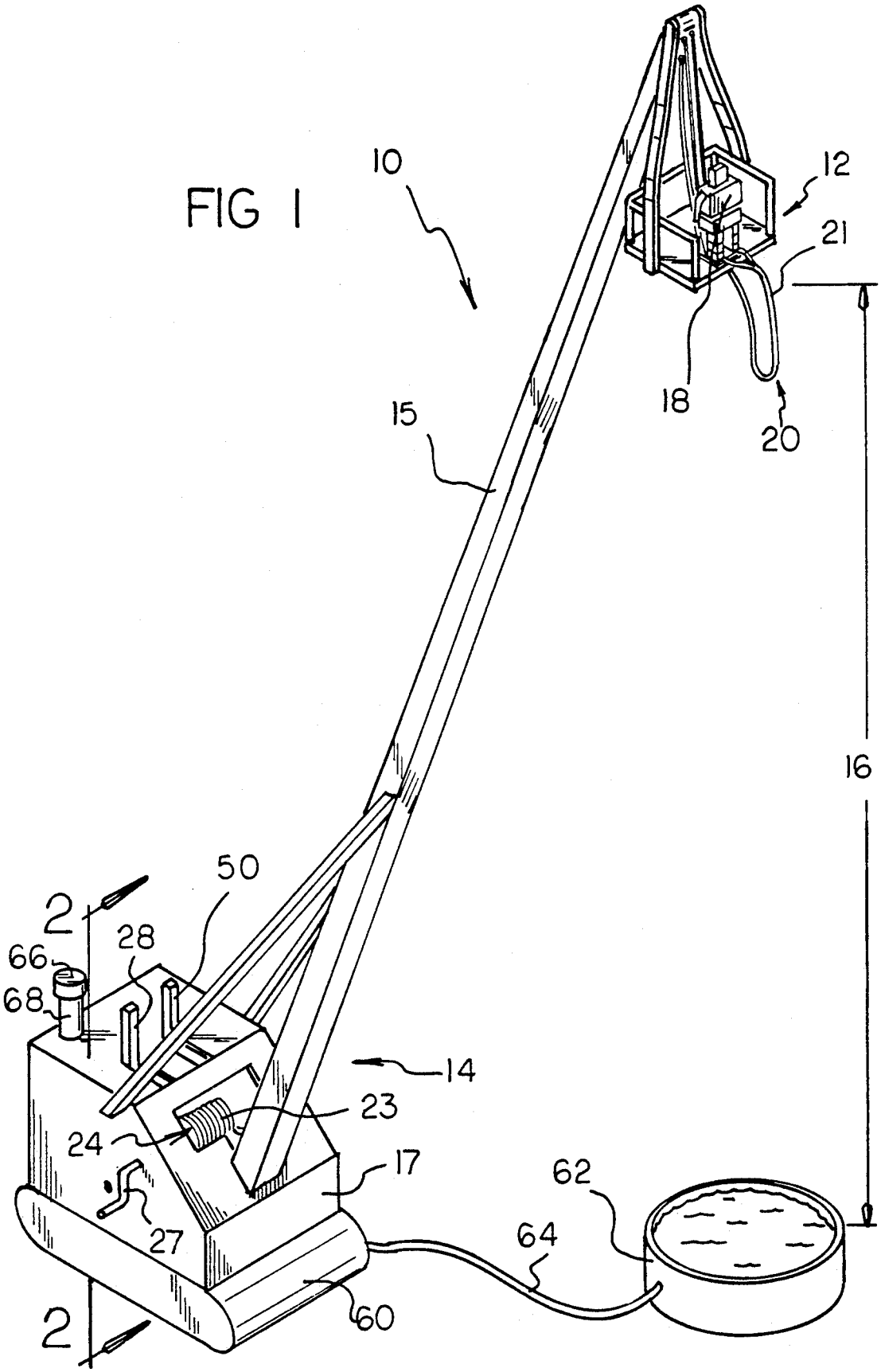
FIG. 1 is a perspective view showing a first preferred embodiment of the bungee jumping toy of the invention.
Figure 2:
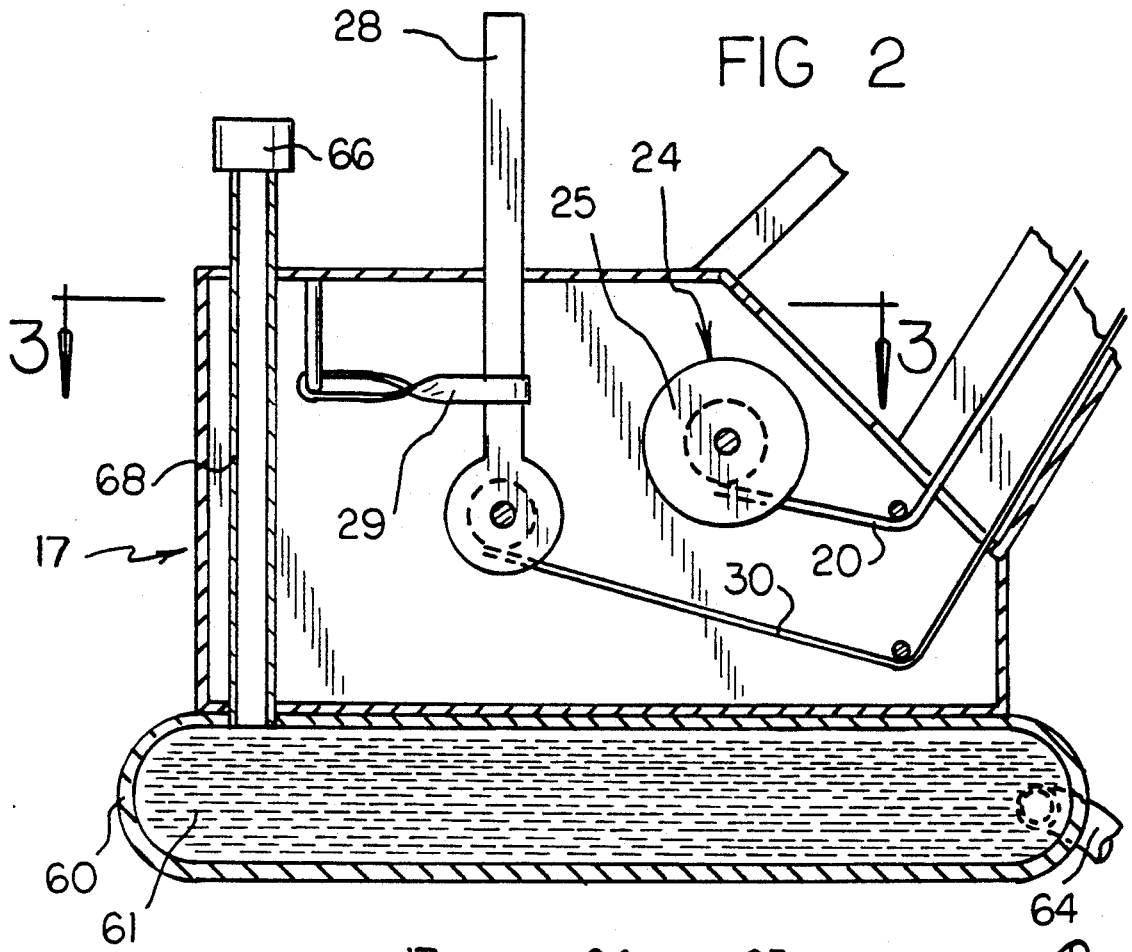
FIG. 2 is an enlarged cross-sectional view of the manual control portion of the crane portion of the embodiment of the apparatus of the invention shown in FIG. 1 taken along line 2—2 of FIG. 1.
Figure 3:
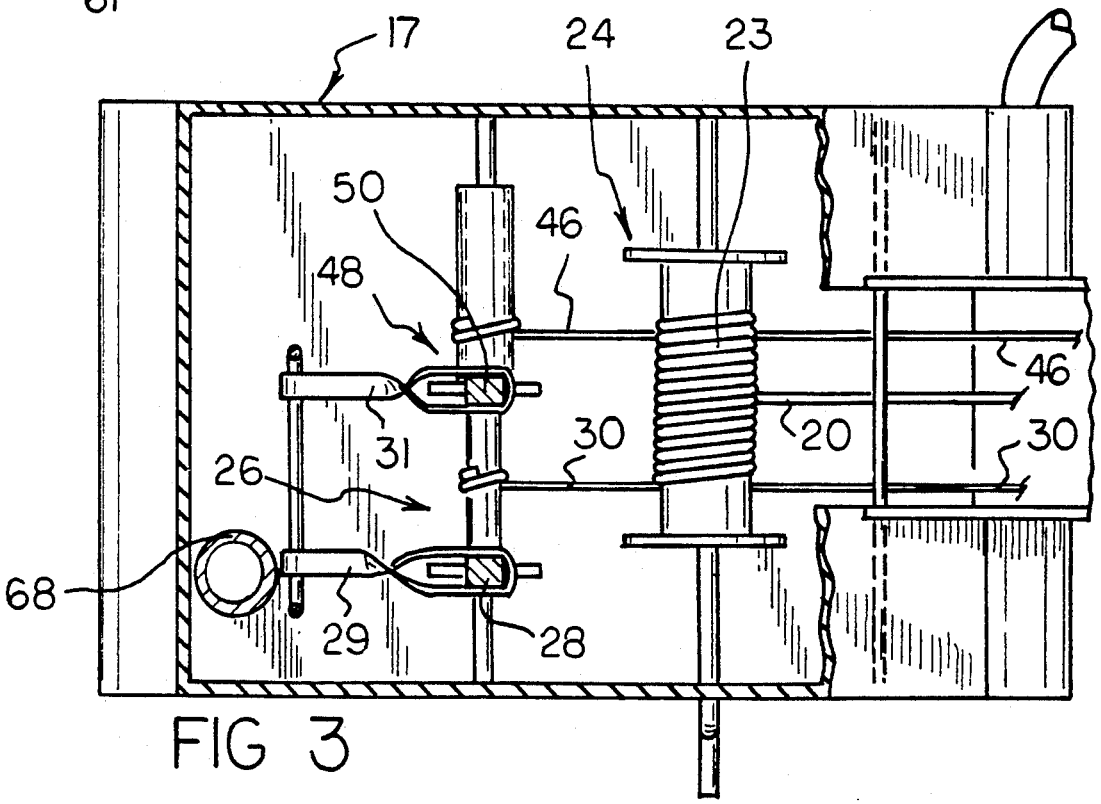
FIG. 3 is an enlarged cross-sectional view of the manual control portion of the crane portion of the embodiment of the apparatus of the invention shown in FIG. 2 taken along line 3—3 of FIG. 2.

Turning initially to FIGS. 1-3, there is shown an exemplary embodiment of the bungee jumping toy of the invention generally designated by reference numeral 10. In its preferred form, bungee jumping toy 10 includes an elevated platform 12 and a platform support assembly 14 for supporting the elevated platform 12 at a predetermined height 16 above ground level. The platform support assembly 14 includes a vertically extending portion 15 which supports the elevated platform 12 and a control portion 17 which supports the vertically extending portion 15. A jumper figure 18 is capable of selectively standing on the elevated platform 12 or of selectively jumping off the elevated platform 12. The platform support assembly 14 can be in the form of a toy crane. In this case, the control portion 17 serves as the cab portion of the crane.

A cord supply assembly 24 is retained in the control portion 17 (the cab portion of the crane). A resilient cord 20 has a first cord portion 21 connected to the jumper figure 18 and has a second cord portion 23 retained by the cord supply assembly 24. A first manual control assembly 26, supported by the platform support assembly 14, is used for controlling a length of the resilient cord 20 that is payed out from the cord supply assembly 24 to the jumper figure 18 as the jumper figure 18 undergoes a jump. The cord supply assembly 24 includes a drum 25 and a hand crank 27 for turning the drum 25 and rewinding the resilient cord 20 after a jump has been executed by the jumper figure 18. The first manual control assembly 26 includes a pivoted, rubber-band-biased first lever 28, a first control line 30 connected to the first lever 28, and a brake plate assembly 32 connected to the first control line 30, such that when the first lever 28 is actuated, the first control line 30 pulls on the brake plate assembly 32 and halts paying out of the resilient cord 20 from the cord supply assembly 24. Rubber band 29 biases the first lever 28 against which the first lever 28 is actuated.

Figure 4:
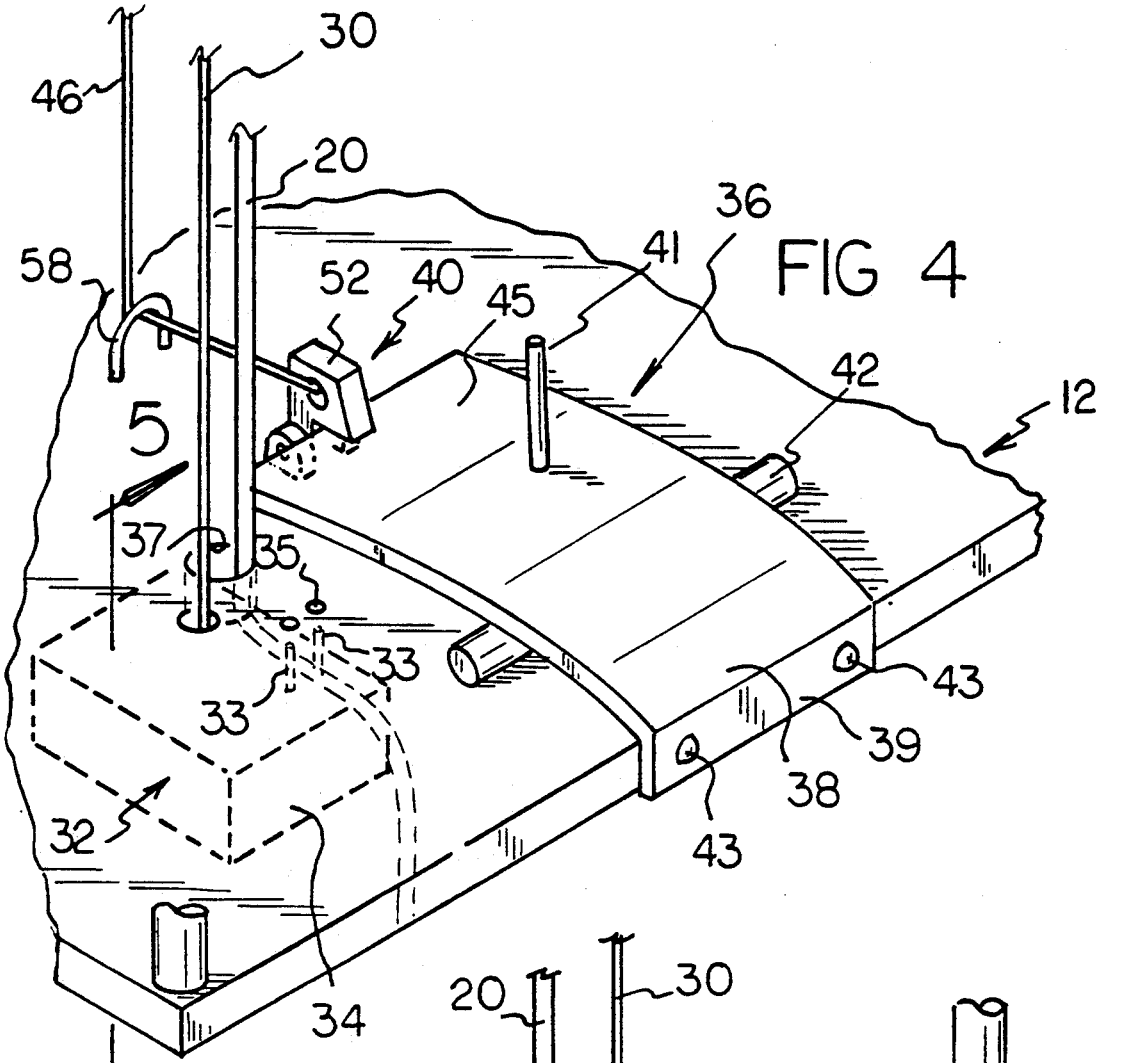
FIG. 4 is an enlarged, perspective view of a portion of a catapult platform of the embodiment of the invention shown in FIG. 1 used by the bungee man for jumping.
Figure 5:
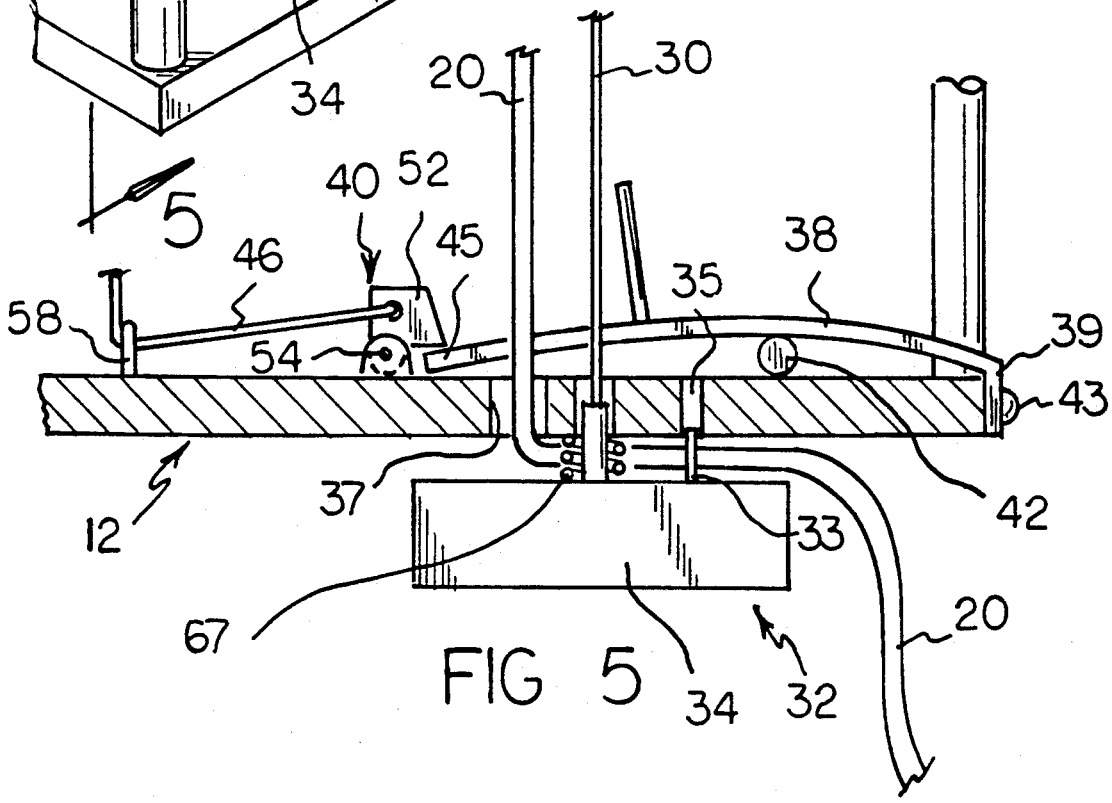
FIG. 5 is a cross-sectional view of the catapult platform of the invention shown in FIG. 4 taken along line 5—5 of FIG. 4.

As shown in FIGS. 4-5, the brake plate assembly 32 includes two vertically projecting guide pins 33 that straddle the resilient cord 20 and ride in complementary guide holes 35 in the elevated platform 12. The elevated platform 12 includes a cord aperture 37 which permits the resilient cord 20 to pass from the platform support assembly 14, through the elevated platform 12, and to the brake plate assembly 32. The brake plate assembly 32 halts paying out of the resilient cord 20 from the cord supply assembly 24 by clamping a portion of the resilient cord 20 between a friction plate 34 in the brake plate assembly 32 and a bottom surface of the elevated platform 12.

Figure 6:
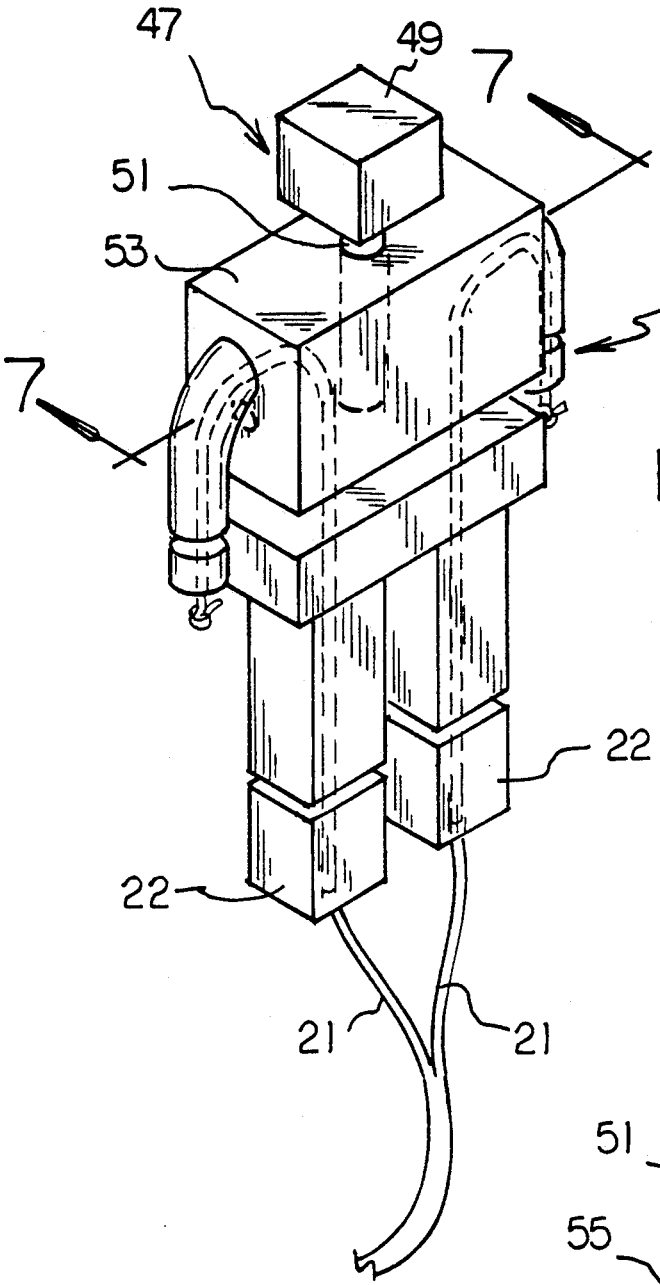
FIG. 6 is an enlarged perspective view of the bungee man shown in the embodiment of the invention shown in FIG. 1.
Figure 7:
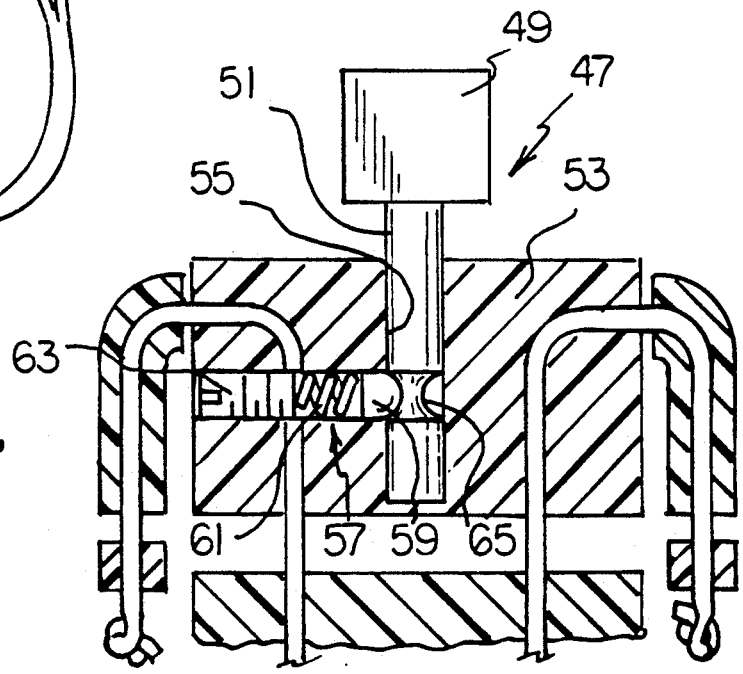
FIG. 7 is an enlarged, partial cross-sectional view of the bungee man shown in FIG. 6 taken along the line 7—7 of FIG. 6.

As shown in FIGS. 6-7, the first cord portion 21 of the resilient cord 20 is connected to feet members 22 of the jumper figure 18. The jumper figure 18 includes a retractable head assembly 47. The retractable head assembly 47 includes a head member 49, a neck member 51 connected to the head member 49, and a torso member 53 which includes a well 55 which slidingly receives the neck member 51. A force exerting assembly 57 is supported by the torso member 53. The force exerting assembly means 57 impedes sliding motion of the neck member 51 within the well 55, such that when the head member 49 is moved toward the torso member 53, the head member 49 maintains its position near the torso member 53.

The force exerting assembly 57 includes a neck-brake member 59 which contacts the neck member 51. A spring member 61 is in contact with the neck-brake member 59 and exerts a biasing force against the neck-brake member 59. An adjustment element 63 is in contact with the spring member 61 and is used for adjusting a frictional force of the spring member 61 against the neck-brake member 59 and the neck member 51. The neck member 51 includes a groove 65 for receiving the neck-brake member 59.

In operation, when a jump is deeper than it should be and the head member 49 of the jumper figure 18 hits a ground surface (or a pool bottom), the head member 49 is moved toward the torso member 53. More specifically, the neck member 51 slides within the well 55 against the neck-brake member 59 that is urged against the neck member 51 by the spring member 61. The force of hitting the head member 49 against the ground surface (or a pool bottom) overcomes the frictional force between the neck-brake member 59 and the neck member 51. However, after the hit against the ground surface (or the pool bottom) takes place, the head member 49 maintains its position near the torso member 53 as a result of the frictional force between the neck-brake member 59 and the neck member 51. This force is overcome only when a user pulls the head member 49 away from the torso member 53.

As shown in FIGS. 4-5, a catapult assembly 36 is connected to the elevated platform 12 and is used for catapulting the jumper figure 18 when the jumper figure 18 undergoes a jump. The catapult assembly 36 includes a spring board assembly 38 which has a first end 39 connected to the elevated platform 12 with fasteners 43. The spring board assembly 38 includes a vertically projecting rod member 41 that engages a complementary hole in the jumper figure 18 to retain the jumper figure 18 on the spring board assembly 38 prior to catapulting the jumper figure 18 off of the spring board assembly 38.

A latch assembly 40 is releasably connected to a second end 45 of the spring board assembly 38. A board tensioning member 42 is placed between the spring board assembly 38 and an upper surface 44 of the elevated platform 12. The board tensioning member 42 is a solid cylinder 42. A second control line 46 is connected to the latch assembly 40 and a second manual control assembly 48 is supported by the platform support assembly 14. The second control line 46 is connected between the latch assembly 40 and the second manual control assembly 48, such that when the second manual control assembly 48 is actuated, the second control line 46 releases the latch assembly 40, and the spring board assembly 38 catapults a jumper figure 18 off of the elevated platform 12.

The second manual control assembly 48 includes a pivoted, rubber-band-biased second lever 50 connected to the second control line 46, such that when the second lever 50 is actuated, the second control line 46 releases the latch assembly 40 and the spring board assembly 38 which catapults a jumper figure 18 off of the elevated platform 12. A rubber band biases second lever 50 against which the second lever 50 is actuated.

The latch assembly 40 includes a pivoted, spring-biased latch element 52, a pivot 54, a pivot support 56, and a line guide 58 for directing a pull on the spring-biased latch element 52 by the second control line 46 and the second lever 50 to be directed away from the spring board assembly 38 to release the spring board assembly 38 from the spring-biased latch element 52 and to catapult the jumper figure 18 into a jump.

As shown in FIGS. 1 and 2, a ballast tank 60 is located below the bottom of the control portion 17 of the platform support assembly 14. The ballast tank 60 is filled with water 61 which serves to provide ballast weight to counterbalance the weight supported by the vertically extending portion 15 and to a prevent the platform support assembly 14 from being tipped over by the weight of the jumper figure 18, the forces on the elevated platform 12 when the jumper figure 18 is catapulted off of the elevated platform 12, and the forces on the elevated platform 12 and when the jumper figure 18 bounces up from its fall.

A pool element 62 is connected to the ballast tank 60 by flexible hose 64. The pool element 62 is filled with water 61. The size of the ballast tank 60 is selected so that it has sufficient water capacity to serve two purposes: first, to ballast the apparatus when the jumper figure 18 undegoes a jump; and, second, to store water that can be drained back from the pool element 62 into the ballast tank 60 when the pool element 62 is lifted above the level of the ballast tank 60, and the tank vent cap 66 permits air to be displaced from the ballast tank 60 by way of vent tube 68.

In operation, the bungee jumping toy 10 of the invention can be used in the following way. First, the pool element 62 is set out and filled with water by water drained from the ballast tank 60. The catapult assembly 36 is armed, that is the spring board assembly 38 is pressed against board tensioning member 42 and latched with latch assembly 40. The jumper figure 18 is placed on the spring board assembly 38, more specifically on vertically projecting rod member 41. The platform support assembly 14 is positioned so that when the jumper figure 18 jumps from the elevated platform 12, the pool element 62 will be below the jumper figure 18.

When the user is ready to play, the user pushes the second lever 50 forward, whereby the second control line 46 is pulled taut. The spring-biased latch element 52 releases its grip on the spring board assembly 38, and the spring board assembly 38 springs up to catapult the jumper figure 18 off of the spring board assembly 38. As the jumper figure 18 falls toward the pool element 62, the weight of the falling jumper figure 18 pulls resilient cord 20 off of the cord supply assembly 24. That is, a portion of the second cord portion 23 unwinds from the drum 25.

When the user deems it appropriate, the user stops release of the resilient cord 20 from the cord supply assembly 24 by pushing on the first lever 28. When first lever 28 is pushed forward, first control line 30 is pulled tight; and the brake plate assembly 32 is actuated. That is, the friction plate 34 clamps the resilient cord 20 against the bottom surface of the elevated platform 12.

The jumper figure 18 will be falling head member 49 first and will be hanging from the first cord portion 21 of the resilient cord 20 by the feet members 22. If the brake plate assembly 32 were actuated sufficiently soon, then either the head member 49 will not fall into the water in the pool element 62, or the head will fall into the water, but the head will not slam into the bottom of the pool member 62. However, if the brake plate assembly 32 were actuated a little too late, a little too much of the resilient cord 20 would have been payed out, and the head member 49 will slam into the bottom of the pool element 62. When this happens, the head member 49 will be pushed against the resistive force provided by the neck-brake member 59, and the neck member 51 will slide deeper into the well 55 and the head member 49 will be closer to the torso member 53. When the user looks at the jumper figure 18 with the slammed in head member 49, the user will know that his jump was not satisfactory.

After the jump is completed, the first lever 28 is pulled back to its initial position, whereby the tension on the first control line 30 is relieved, and the brake plate assembly 32 returns to its normally open position by return spring 67. Then, the resilient cord 20 is wound back onto the drum 25 by turning hand crank 27. After the resilient cord 20 is rewound, the catapult assembly 36 is reset, and the jumper figure 18 is placed on the spring board assembly 38. At this stage, the bungee jumping toy 10 of the invention is ready for the next player.

If desired, the bungee jumping toy 10 of the invention can be used in the context of a competitive game between a number of players. A player's score will increase when greater accuracy is shown. Greater accuracy can be manifested by getting as close as possible to the ground or water level without touching. A player's score may also increase by having the jumper figure 18 jump from a greater height. A variation in the game can take place by having a variety of different size jumper figures 18, a variety of resilient cords 20 having different degrees of resiliency, and an adjustable vertically extending portion 15 so that greater or lesser jumping heights can be selected. A player's score may decrease when the jumper figure 18 gets wet or, worse, when the head member 49 of the jumper figure 18 slams against the ground surface or bottom surface of the pool causing the head member 49 to move toward the torso member 53.

The components of the bungee jumping toy of the invention can be made from inexpensive and durable metal and plastic materials.

It is apparent from the above that the present invention accomplishes all of the objects set forth by providing a new and improved bungee jumping toy that is low in cost, relatively simple in design and operation, and which may advantageously be used to permit children and others to experience some of the desirable characteristics of bungee jumping without actually participating in bungee jumping. With the invention, a bungee jumping toy is provided which permits the physically infirmed to experience some of the desirable characteristics of bungee jumping without actually participating in bungee jumping. With the invention, a bungee jumping toy is provided which provides some of the desirable characteristics of bungee jumping without the need for expensive equipment and expensive land use. With the invention, a person is not required to go to elevated heights. With the invention, a participant is not subjected to physical danger if the bungee cord were to break during a jump. With the invention, a person is not required to travel considerable distances away from home. With the invention, a bungee jumping toy is provided which provides some competitive aspects of bungee jumping without any of the physically challenging aspects of the sport. With the invention, a bungee jumping toy is provided which provides some of the advantages of and, at the same time, eliminates some of the disadvantages of the sport of bungee jumping. With the invention, a bungee jumping toy is provided which simulates bungee jumping and which employs a toy crane. With the invention, a participant is rewarded for executing a jump that maximizes speed, that maximizes the height of the jump, and that minimizes the distance between the bottommost point of the fall and the ground or water surface. With the invention, a participant is penalized for executing a jump in which the jumper crashes into the ground or the jumper becomes undesirably immersed in a body of water. With the invention, a bungee jumping toy is provided which simulates damage to a simulated person if the simulated person crashes into the ground.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved bungee jumping toy, comprising:

an elevated platform, a platform support assembly for supporting said elevated platform at a predetermined height above ground level, said platform support assembly including a vertically extending portion which supports said elevated platform and a control portion which supports said vertically extending portion, a jumper figure capable of selectively standing on said elevated platform or of selectively jumping off said elevated platform, a cord supply assembly retained by said platform support assembly, a resilient cord having a first cord portion connected to said jumper figure and having a second cord portion retained by said cord supply assembly, and first manual control assembly means, supported by said platform support assembly, for controlling a length of said resilient cord payed out from said cord supply assembly to said jumper figure as said jumper figure undergoes a jump.

2. The apparatus described in claim 1 wherein said first manual control assembly includes a pivoted, rubber-band-biased first lever, a first control line connected to said first lever, and a brake plate assembly connected to said first control line, such that when said first lever is actuated, said first control line pulls on said brake plate assembly and halts paying out of said resilient cord from said cord supply assembly.

3. The apparatus described in claim 2 wherein said brake plate assembly halts paying out of said resilient cord from said cord supply assembly by clamping a portion of said resilient cord between a friction plate in said brake plate assembly and a bottom surface of said elevated platform.

4. The apparatus described in claim 1 wherein said platform support assembly is comprised of a toy crane.

5. The apparatus described in claim 1 wherein said first cord portion of said resilient cord is connected to feet members of said jumper figure.

6. The apparatus described in claim 1 wherein said jumper figure includes a retractable head assembly.

7. The apparatus described in claim 6 wherein retractable head assembly includes:

a head member, a neck member connected to said head member, a torso member which includes a well which slidingly receives said neck member, and force exerting assembly means, supported by said torso member, for impeding sliding motion of said neck member within said well, such that when said head member is moved toward said torso member, said head member maintains its position near said torso member.

8. The apparatus described in claim 7 wherein said force exerting assembly means include:

a neck-brake member which contacts said neck member, a spring member, in contact with said neck-brake member, for exerting a biasing force against said neck-brake member, and an adjustment element, in contact with said spring member, for adjusting a frictional force of said spring member against said neck-brake member and said neck member.

9. The apparatus described in claim 8 wherein said neck member includes a groove for receiving said neck-brake member.

10. The apparatus described in claim 1, further including:

a catapult assembly, connected to said elevated platform, for catapulting said jumper figure when said jumper figure undergoes a jump.

11. The apparatus described in claim 10 wherein said catapult assembly includes:

a spring board assembly having a first end connected to said elevated platform, a latch assembly releasably connected to a second end of said spring board assembly, a board tensioning member, placed between said spring board assembly and an upper surface of said elevated platform, a second control line, connected to said latch assembly, and second manual control assembly means supported by said platform support assembly, said second control line connected between said latch assembly and said second manual control assembly means, such that when said second manual control assembly means is actuated, said second control line releases said latch assembly, and said spring board assembly catapults said jumper figure off of said elevated platform.

12. The apparatus described in claim 11 wherein said second manual control assembly includes a pivoted, rubber-band-biased second lever connected to said second control line, such that when said second lever is actuated, said second control line releases said latch assembly and said spring board assembly which catapults said jumper figure off of said elevated platform.

13. The apparatus described in claim 11 wherein said latch assembly includes a pivoted, spring-biased latch element, a pivot, a pivot support, and a line guide for directing a pull on said spring-biased latch element by said second control line and said second lever to be directed away from said spring board assembly to release said spring board assembly from said spring-biased latch element and to catapult said jumper figure into a jump.

14. The apparatus described in claim 1, further including:

a ballast tank located at a bottom of said control portion of said platform support assembly.

15. The apparatus described in claim 14, further including:

a pool element connected to said ballast tank by flexible hose.

* * * * *